US006021290A

United States Patent [19]

Hamada et al.

[11] Patent Number: 6,021,290

[45] Date of Patent: Feb. 1, 2000

[54] IMAGE FORMING APPARATUS WITH VENTILATION

[75] Inventors: Tatsuo Hamada; Ryukichi Inoue, both of Abiko; Yoshiyuki Yamazaki, Toride; Yoshihiro Matsuo, Abiko; Yoshihisa Ibaraki, Toride, all of Japan

[73] Assignee: Canon Kabushiki Kaisha, Tokyo, Japan

[21] Appl. No.: 08/901,283

[22] Filed: Jul. 29, 1997

[30] Foreign Application Priority Data

Jul. 31, 1996 [JP] Japan ..... 8-201889
Mar. 6, 1997 [JP] Japan ..... 9-051908

[51] Int. Cl.[7] ..... G03G 15/00

[52] U.S. Cl. ..... 399/92; 399/94

[58] Field of Search ..... 399/92, 91, 94, 399/97, 93; 347/152, 156

[56] References Cited

U.S. PATENT DOCUMENTS 4,891,678 1/1990 Ishizu et al. ..... 399/91
5,132,731 7/1992 Oda ..... 399/92
5,512,975 4/1996 Kitsu et al. ..... 399/92 X

FOREIGN PATENT DOCUMENTS 4-86837 3/1992 Japan .
7-295379 11/1995 Japan .
9-106239 4/1997 Japan .

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An exhaust mechanism for use in an image development apparatus exhausts air from within the apparatus, taking advantage of an air flow generated by the heating of a fixing unit without the need for an air blower. The apparatus includes a transport path for allowing a recording medium, to which a toner image formed on a photoconductive body, is transferred, to pass therethrough, a transfer unit disposed below the photoconductive body for transferring the toner image to the recording medium, the fixing unit having a heater, and a partitioning plate which separates a space formed below the transfer unit from a space that accommodates the photoconductive body, a toner image forming unit, and the fixing unit, and which is provided with an opening for permitting air to flow near the transfer unit. With this arrangement, a ventilation path for exhausting air outwardly from within the apparatus is formed without the need for the air blower, in which a rising air flow is exhausted, passing through the opening in the partitioning plate, near the transfer unit, and through an opening formed in the cabinet of the body of the apparatus.

23 Claims, 8 Drawing Sheets

IMAGE FORMING APPARATUS WITH VENTILATION

BACKGROUND OF THE INVENTION

1. Field of the Invention

The present invention relates to an image development apparatus such as a laser beam printer (hereinafter referred to as LBP) and a photocopying machine, having a cooling device.

2. Description of the Related Art

A typical construction of low-cost LBPs today is shown in FIG. 8. In this construction, a paper feeder section 61, a transfer section 62, a fixing section 63, a process cartridge 64 and the like are closely mounted on a center stay member 60 as printer building members to shorten a recording medium transport path Q, while electronics 65 are arranged together below the center stay member 60 to make the entire construction of the LBP compact.

A fixing unit that constitutes the fixing section 63 adopts, instead of a heating roller method of using a halogen heater, a fixing method which causes a pressure roller 63*c* to press a heat-resistant film 63*b* against a flat-plate ceramic heater 63*a* so that a recording medium P fed into a nip formed between the heat resistant film 63*b* and the pressure roller 63*c* is allowed to advance along with the heat resistant film 63*b* (hereinafter, this method is referred to as SURF fixing method). The SURF fixing method completely switches off the heater when not in use, to save power, and offers many excellent features such as quick start and less-wait-time features.

Since the heater is switched off for durations other than printing operation periods, heat generation from the fixing unit is minimized, and thus a cooling fan for cooling the body of the apparatus, which would be essentially required if a heating roller type fixing unit was employed, is dispensed with. This arrangement substantially contributes to compact design and substantial cost reduction of the apparatus.

However, the conventional fan-less compact LBP thus constructed presents the following disadvantages.

(1) Since the process cartridge 64 is mounted closely to the fixing section 63 to make the entire structure of the printer compact as shown in FIG. 8, the process cartridge 64 is subject to heat emitted from the fixing section 63. Particularly when a large quantity of printing jobs is performed continuously, heating effect is considerable even in the SURF fixing method because the heater remains switched on continuously for a long time. In the course of such heating, the surface temperature of a photoconductive drum as an image bearing body increases, possibly adversely affecting electrostatic image formation on a development section.

If a cleaning container 64*a* for recycling toner residing on the photoconductive drum is heated after a transfer operation, waste toner in the vicinity of a cleaning blade 64*b* solidifies and a cleaning operation possibly malfunctions.

(2) When a large quantity of printing jobs is done, heated air builds up within an upper space which accommodates the fixing unit, not only because the fixing heater of the fixing section as a major heat source remains switched on for a long period of time but also because the center stay member 60 separates the upper space and a lower space, respectively, above and below the recording medium transport path Q. As a result, the internal temperature of the apparatus rises.

(3) When a large quantity of printing jobs is performed with no cooling fan employed, the fixing unit that has been heated starts giving off heat at the end of a printing operation. The internal temperature in the cabinet of the printer is expected to rise higher than even at the time of printer stop.

SUMMARY OF THE INVENTION

It is an object of the present invention to provide a solution to the problem of exhausting the air from within the cabinet of a conventional electrophotographic image development apparatus.

It is another object of the present invention to provide a ventilating mechanism that needs no particular component for ventilation and generates no noise.

To achieve the above objects, the exhaust mechanism of the electrophotographic image development apparatus of the present invention includes an apparatus body; an electrophotographic photoconductive body disposed in the apparatus body; toner image forming means for forming a toner image on the electrophotographic photoconductive body; and a recording medium transport path for allowing to pass therethrough a sheet-like recording medium, to which the toner image formed on the photoconductive body is to be transferred. The mechanism further includes transfer means, disposed below the photoconductive body, for transferring the formed toner image to the recording medium; fixing means, disposed above a plane of the recording medium transport path and having a heater body, for fixing the toner image transferred to the recording medium by the transfer means; and a partitioning member which separates a space formed below the transfer means from a space that accommodates the photoconductive body, the toner image forming means, and the fixing means. The partitioning member is provided with an opening for permitting air to flow near the transfer means, wherein a ventilation path for outwardly exhausting air from within the apparatus body includes the opening in the partitioning member and an opening in an outer portion of the apparatus body, and wherein a convective air flow generated when the fixing means is heated rises along the ventilation path and passes near the transfer means and around the photoconductive body and the toner image forming means, arranged above the opening in the partitioning member, and is exhausted through the opening in the outer portion of the apparatus body.

DESCRIPTION OF THE PREFERRED EMBODIMENTS

First Embodiment

Figure 1:
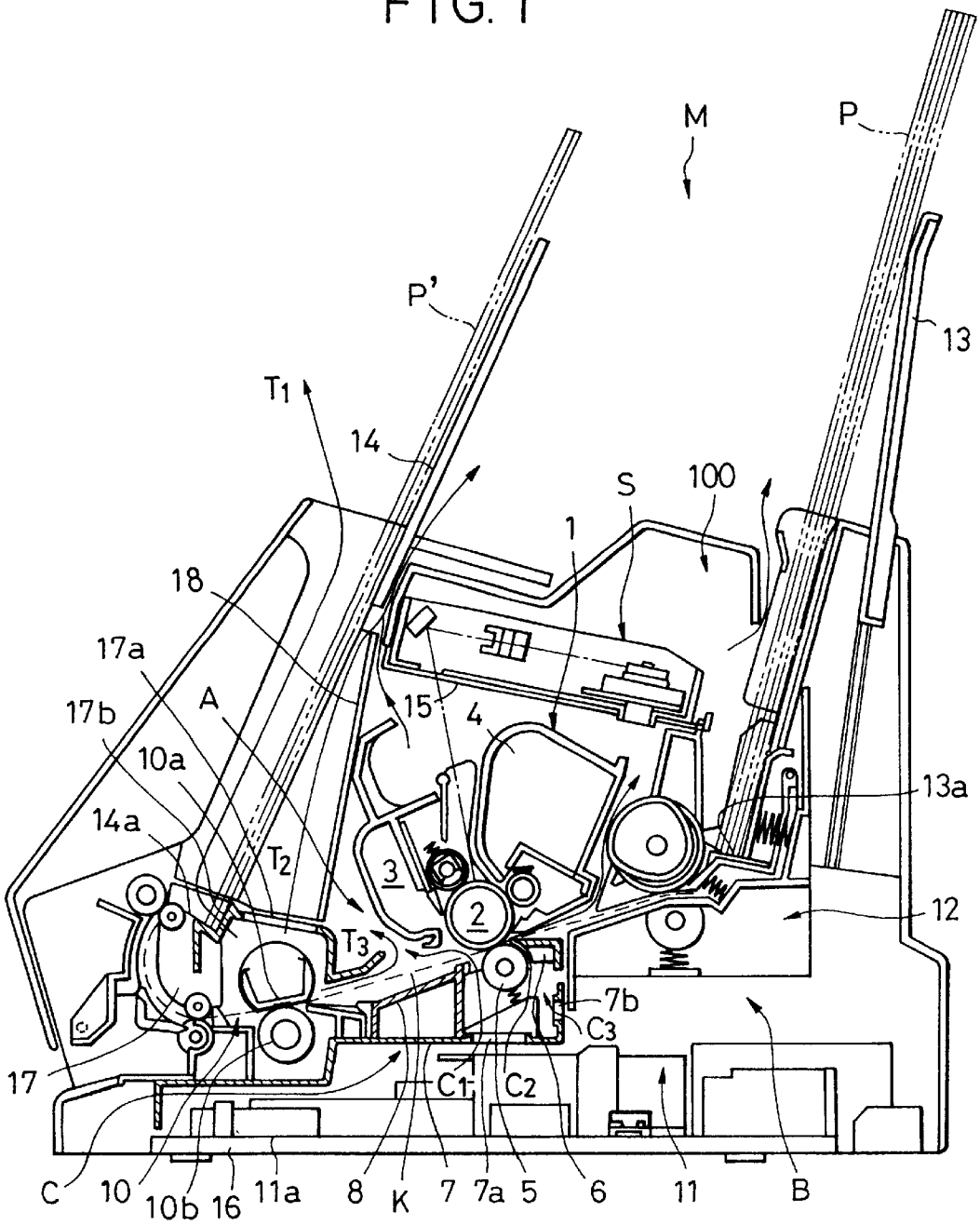
FIG. 1 is a cross-sectional view showing generally a first embodiment of the image development apparatus of the present invention.
Figure 2:
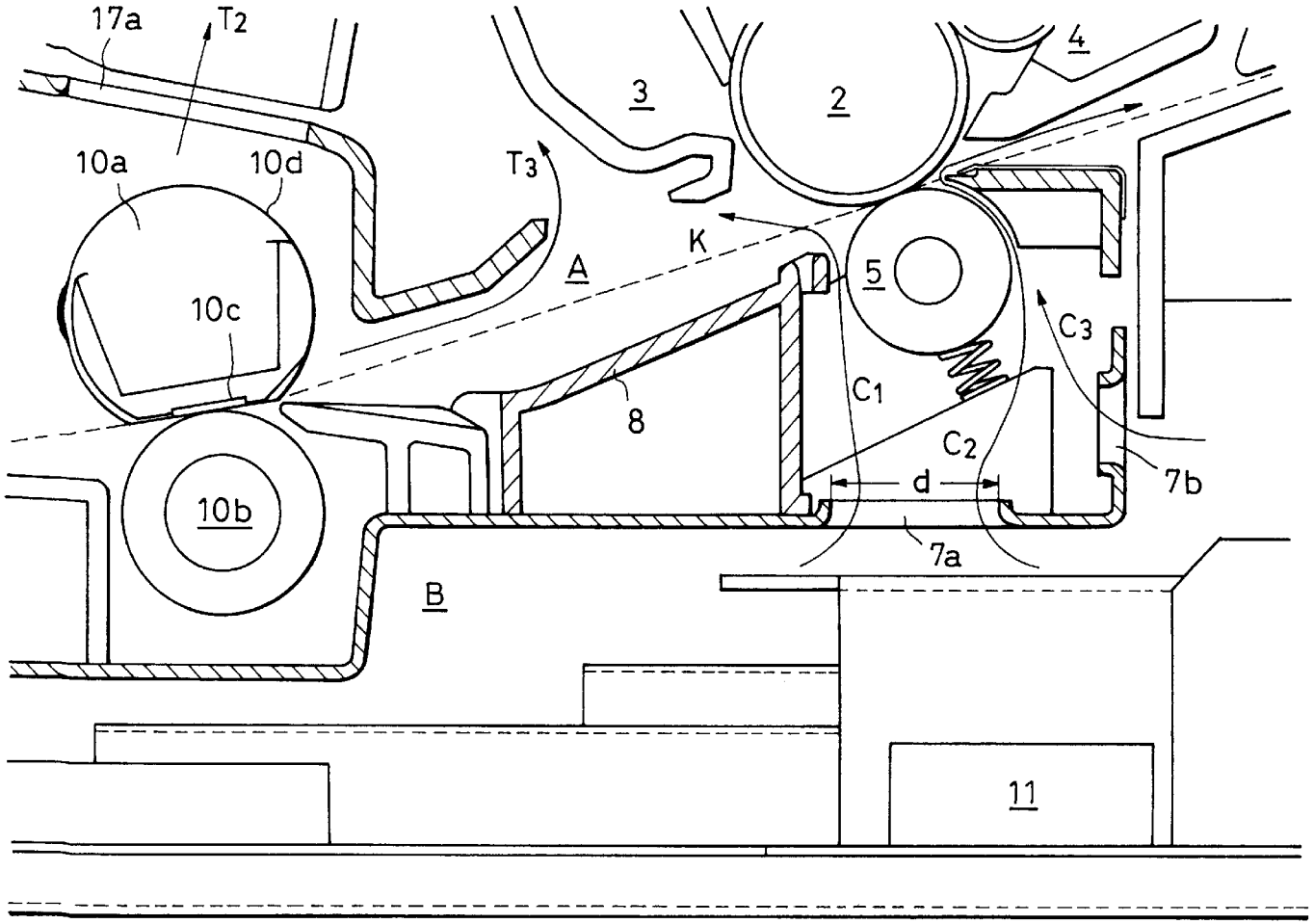
FIG. 2 is an enlarged cross-sectional view of a major portion of the first embodiment.
Figure 3:
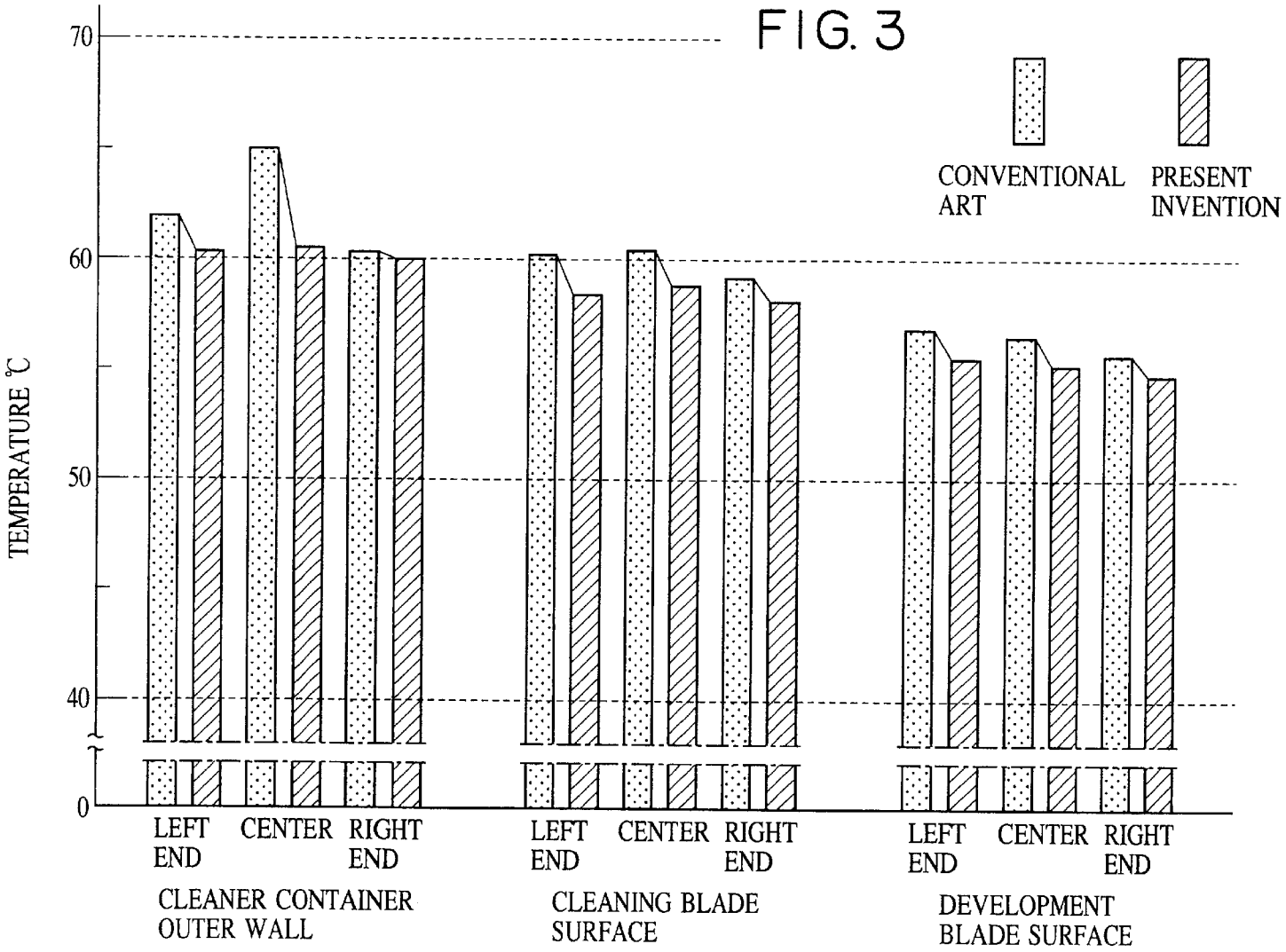
FIG. 3 shows temperature measurement results of the major portion of the first embodiment in comparison with those of conventional art.

Referring to FIGS. 1 through 3, a first embodiment of the image development apparatus of the present invention is now discussed.

As one example of the image development apparatus, FIG. 1 shows generally a laser beam printer M (hereinafter referred to as printer M) that employs a detachable process cartridge. Throughout in their cross-sectional views, the printers are shown with their front on the left-hand side and their back on the right-hand side. Thus, the upstream side and downstream side in terms of the advance of recording medium P are aligned, respectively, with the back and the front of the printer. Acceptable as the recording medium P on which an image is developed are plain paper (copying paper), thick sheet paper, special paper such as envelopes, sheet material, other than paper, such as an over-head projector film, and the like. In the following discussion of the embodiments, however, plain paper is assumed.

The construction of the printer M is now discussed.

The printer body 100 (hereinafter simply referred to as body 100) of the printer M has, on its back side, first support means 13 for holding a recording medium P in its generally upright position prior to image development and on its front side, second support means 14 for holding a recording medium P' in its generally upright position after image development. The body 100 means not only the outer cover of the printer M but also the inner frame of the printer M. The bottom end portion 13*a* of the first support means 13 is connected to the bottom end portion 14*a* of the second support means 14 by a transport path K that runs from back to front in the body 100 (as shown by a dashed line), and these components form a generally U-shaped path if viewed in cross section. The printer M also includes a process cartridge 1 integrally comprising a photoconductive drum 2 immediately above the transport path K, a cleaning section 3, and a development section 4, a scanner S arranged above the process cartridge 1, a transfer section 5 in the middle of the transport path K below the photoconductive drum 2 in a manner that the transfer section 5 is diametrically opposed to the photoconductive drum 2, and a fixing section 10 arranged closely below the bottom end portion 14*a* of the second support means 14 on the downstream side of the transport path K.

If viewed with respect to the U-shaped path, the process cartridge 1, the scanner S and the heater 10*a* of the fixing section 10 are surrounded by the U-shaped path, and the transfer section 5 and the pressure roller 10*b* of the fixing section 10 are arranged outside the U-shaped path.

The frame of the body includes a stay member 6, 7 constructed of unshown left and right side plates and a central sheet member, a top plate 15 for supporting the scanner S, and a bottom plate 16 for supporting electronics 11. Mounted on the stay member 7 are the transfer section 5, a transport guide section 8, the fixing section 10 and the like.

A paper feeder section 12, the process cartridge 1 and the fixing section 10 are arranged as closely as possible to shorten the length of the transport path. As a result, the transport time of the recording medium P is reduced, a fast print rate is achieved, and the vertically arranged first and second support means 13, 14 form a more compact U-shaped path. The entire structure of the printer is accordingly made compact.

As shown in FIG. 2, the fixing section 10 causes a pressure roller 10*b* to press a heat-resistant film 10*d* against a flat-plate ceramic heater 10*c* while advancing the heat-resistant film 10*d* so that a recording medium P fed into a nip formed between the heat-resistant film 10*d* and the pressure roller 10*b* is allowed to advance along with the heat resistant film 10*d*. In this SURF fixing method, the heater, when not in use, is completely switched off to save power, and many excellent features such as quick start and less-wait-time features are realized. Furthermore, the heater is switched off for durations other than printing operation periods, heat generation from the fixing unit is minimized, and thus a cooling fan for cooling the body of the apparatus, which would be essentially required if a heating roller type fixing unit was employed, is dispensed with. This arrangement substantially contributes to compact design and substantial cost reduction of the apparatus.

When a large quantity of printing jobs is performed, the fixing heater 10*c* as a heat source remains switched on for a long period of time, giving off heated air from the fixing section 10. In this case, most of heated air is exhausted outwardly along a wall plate 18 through exhaust passages 17*a*, 17*b* formed in a fixing section cover 17 as shown by T1, T2 (FIG. 1). However, if part of the heated air moves to the side of the process cartridge 1 as shown by T3, the cleaning section 3 and the photoconductive drum 2 of the process cartridge 1 closest to the fixing section 10 will be warmed.

The stay member 7 as a partitioning member partitions the inner space into an upper space A above the transport path K and a lower space B below the transport path K. The air temperature within the upper space A in which the fixing section 10 is accommodated rises while the air temperature within the lower space B in which the electronics 11 are accommodated rises only slightly. Thus, a temperature difference results between both spaces.

The temperature difference between the upper space A and the lower space B generates a rising air flow by convection, and the air within the upper space A (relatively higher in temperature) is exhausted outwardly through an unshown exhaust port or gaps, while the air within the lower space B (relatively lower in temperature) enters into the upper space A.

In this case, as shown by arrows C1, C2 and C3 in FIG. 2, the relatively lower temperature air passes through ventilation paths routed through a ventilation opening 7*a* and a side ventilation opening 7*b* formed in the stay member 7, below the photoconductive drum 2 and the transfer section 5, and then passes along the surface of the photoconductive drum 2, the surface of the cleaning section 3, and the surface of the development section 4, and in the course of the movement of the air, these components are positively cooled.

Such an air flow is chiefly formed by the ventilation opening 7*a* in the stay member 7. The ventilation opening 7*a* has preferably a continuous one length substantially coextensive with the transfer section 5, or may be constituted of a plurality of discontinuous openings formed in the stay member 7 from the standpoint of reinforcement. The width d of the opening is 5 to 50 mm long, and preferably 10 to 20 mm long along the transport path K. The width d may be determined taking into consideration the heat generation rate of the printed circuit board below and the fixing section.

FIG. 3 shows temperatures measured at principal points of the major components in the bodies of two types, one with this embodiment incorporated and the other as conventional art with ventilation paths sealed. The principal points in the major components where temperatures were measured herein are the left end, center and right ends of each of the outer walls of the cleaning container of the process cartridge, the surface of a cleaning blade, and the surface of a development blade.

As will be seen from FIG. 3, this embodiment is approximately 4° C. lower in temperature than the conventional art at the center of the outer wall of the cleaning container, approximately 2° C. lower than the conventional art in the cleaning blade, and approximately 1° C. lower than the conventional art in the development blade.

With the embodiment incorporated, the ambient temperature of the process cartridge is lowered without the need for a cooling device such as a fan, and thus the printer is free from faulty cleaning arising from the temperature rise in the process cartridge and deterioration in image quality, and develops a high-quality image.

Second Embodiment

Figure 4:
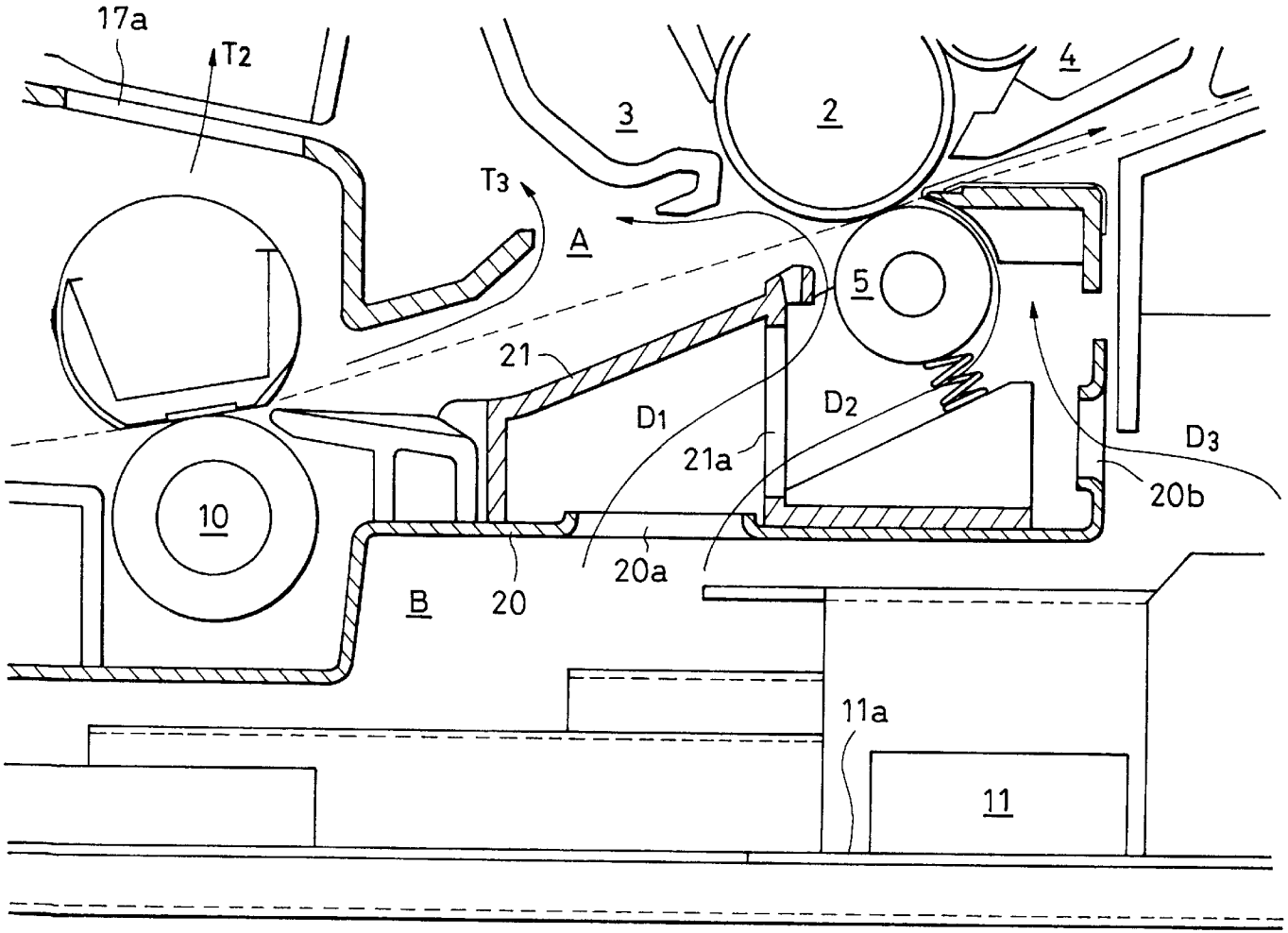
FIG. 4 is an enlarged cross-sectional view of a major portion of a second embodiment of the present invention.
Figure 5:
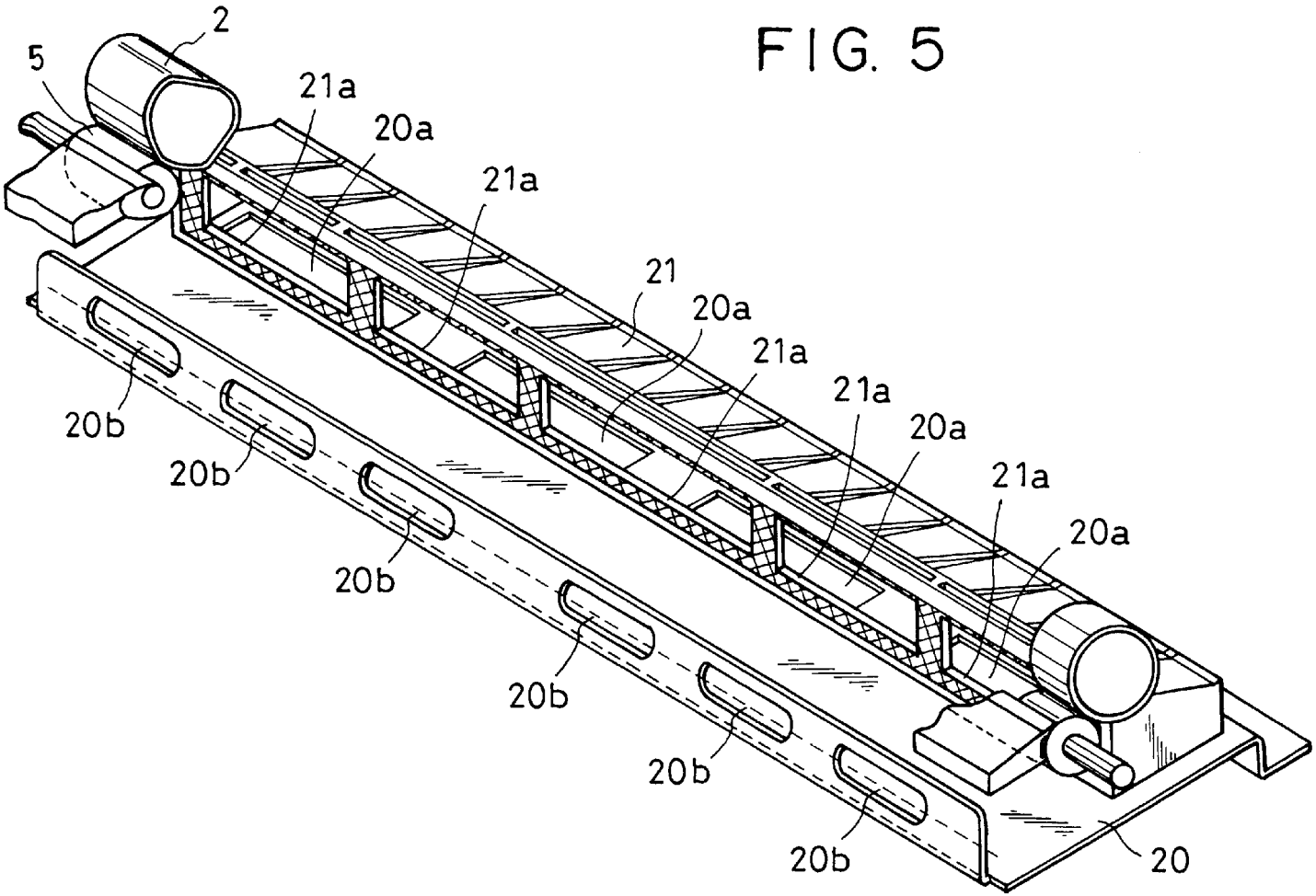
FIG. 5 is a perspective view of the major portion shown in FIG. 4.

FIGS. 4 and 5 show a second embodiment of the present invention.

In the first embodiment, the ventilation path constituted by the ventilation opening 7*a* formed in the stay member 7 is arranged just below the photoconductive drum 2 and the transfer section 5. In the second embodiment, a first ventilation path constituted by a ventilation openings 20*a*, 20*b* formed in a stay member 20 is arranged in the area enclosed by a transport guide 21, and further, a second ventilation path is constituted by a ventilation opening 21*a* formed in a vertical wall portion of the transport guide 21. Relatively cooler air from a lower space B is allowed to flow as shown by arrows D1, D2, and D3, thereby cooling the process cartridge 1 in the same way as the first embodiment.

Since the horizontal portion of the stay member 20 extends below gaps surrounding the transfer section 5, paper clips, staples, toner, paper debris and the like are prevented from falling through the gaps surrounding the transfer section 5 directly down to a printed circuit board 11*a* of the electronics 11, and thus the risk of fault and fire caused by them is reduced.

Third Embodiment

Figure 6:
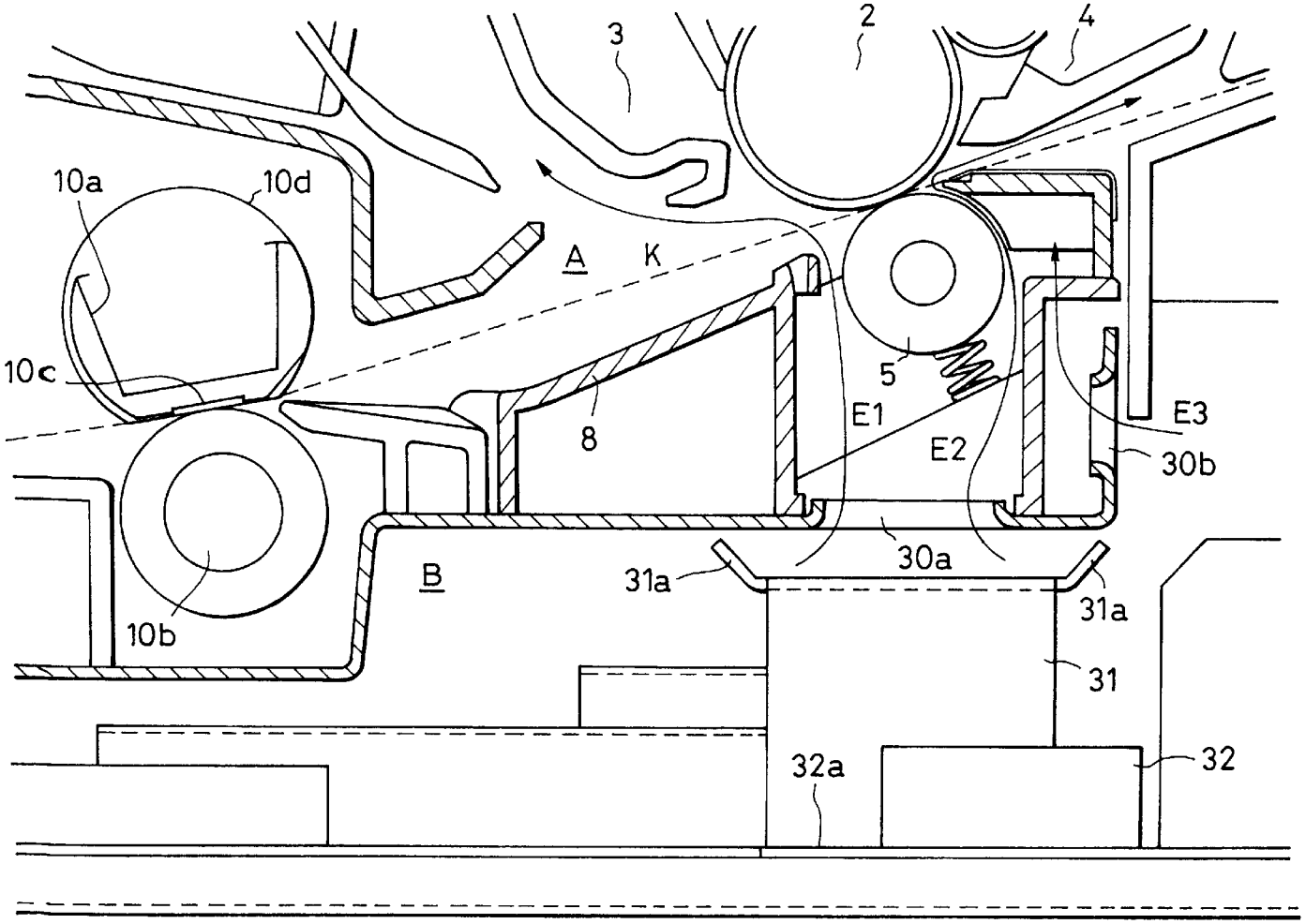
FIG. 6 is an enlarged cross-sectional view of a major portion of a third embodiment of the present invention.

FIG. 6 shows a third embodiment of the present invention.

In the first embodiment, no barrier is provided in the ventilation path formed in the stay member right below the transfer section, and thus the gaps surrounding the transfer section are directly open down to the electronics. In the third embodiment, the top surface 31*a* of the heat sink plate 31 mounted on electronics 32 is saucer-like shaped. Relatively cooler air from the lower space B flows as shown by arrows E1, E2, and E3, thereby cooling the process cartridge 1 in the same way as the first embodiment.

Since the saucer-like top surface 31*a* of the heat sink plate is arranged below a ventilation opening 30*a*, paper clips, staples, toner, paper debris and the like are prevented from falling through the gaps surrounding the transfer section 5 directly down to a printed circuit board 32*a* of the electronics 32, and thus the risk of fault and fire of the electronics 32 caused by them is reduced.

Fourth Embodiment

Figure 7:
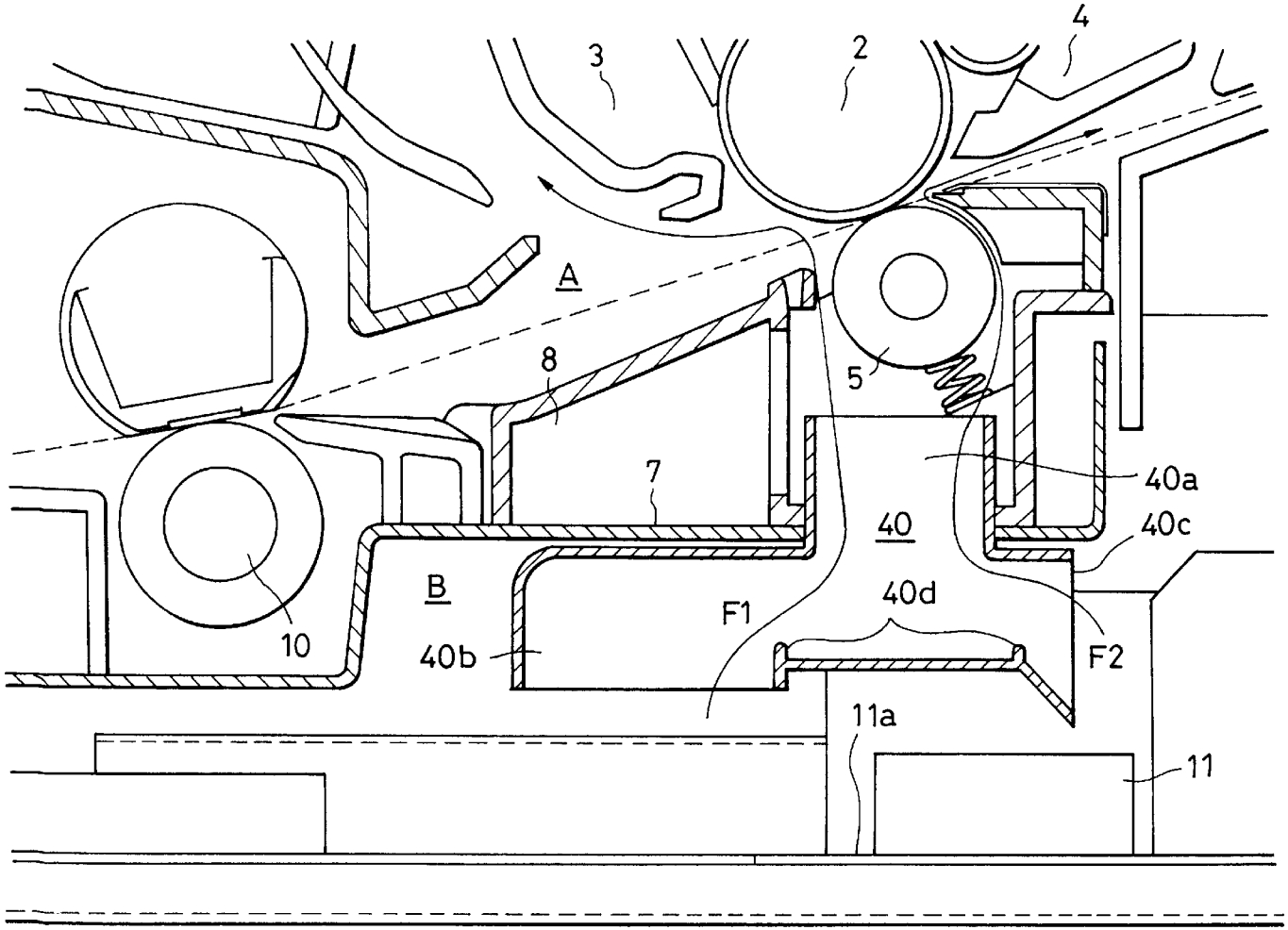
FIG. 7 is an enlarged cross-sectional view of a major portion of a fourth embodiment of the present invention.
Figure 8:
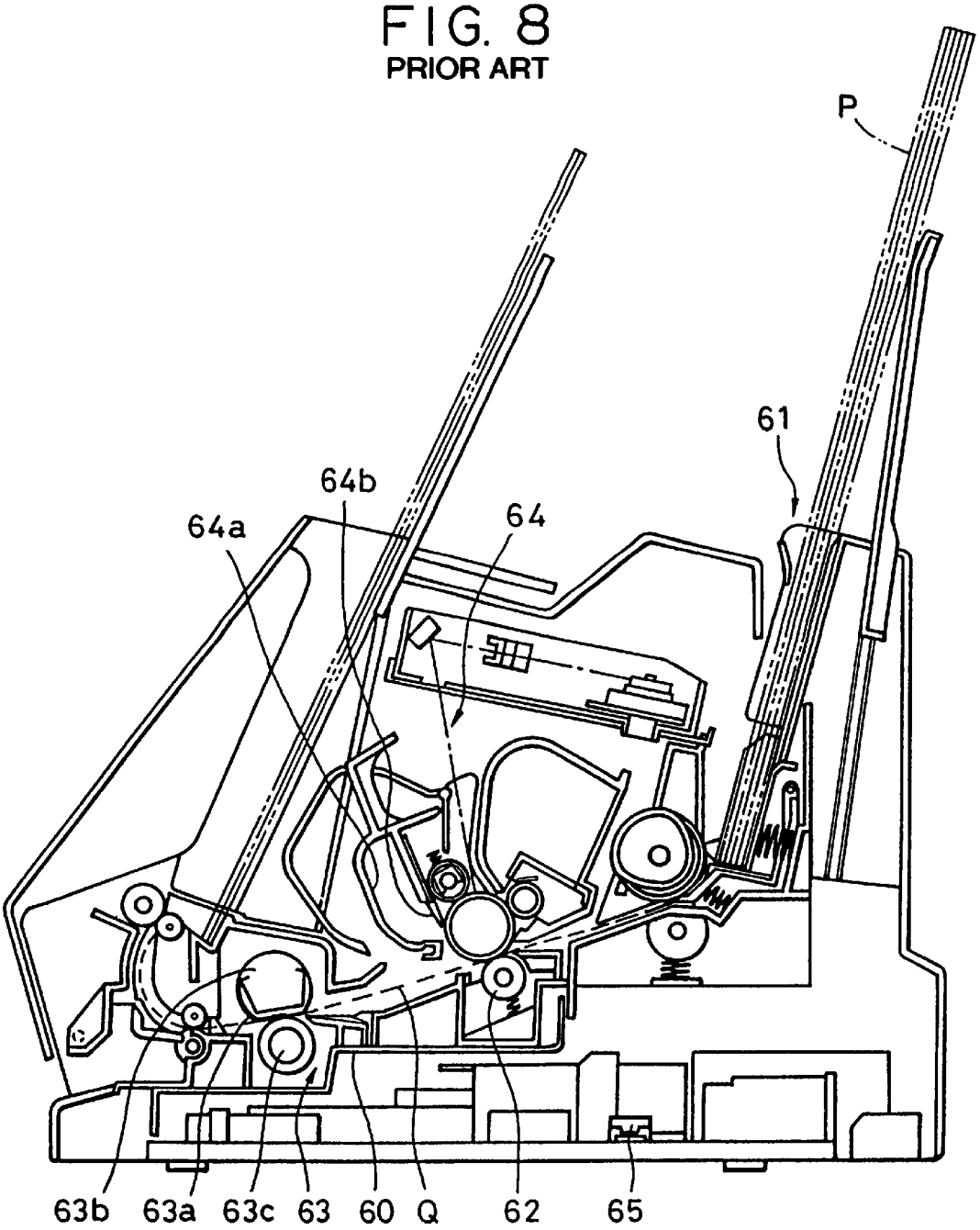
FIG. 8 PRIOR ART
FIG. 8 is a cross-sectional view showing generally the conventional image development apparatus.

FIG. 7 shows a fourth embodiment of the present invention.

In the first embodiment, no barrier is provided in the ventilation path formed in the stay member right below the transfer section, and thus the gaps surrounding the transfer section are directly open down to the electronics. In the fourth embodiment, a duct 40 is provided to make the space below the transfer section 5 communicate with the lower space B surrounding the electronics 11. Relatively cooler air from the lower space B flows as shown by arrows F1 and F2, thereby cooling the process cartridge 1 in the same way as the first embodiment.

The bottom surface of the ventilation paths 40*a*, 40*b*, and 40*c* of the duct 40 is provided by side projections 40*d* in a saucer-like configuration, and thus paper clips, staples, toner, paper debris and the like are prevented from falling through the gaps surrounding the transfer section 5 directly down to a printed circuit board 11*a*, and thus the risk of fault and fire of the electronics 11 caused by them is reduced.

According to the present invention, the ventilation opening is formed in the partitioning member such as the stay member or a functional member that partitions the inner space of the printer into the upper space and lower space, above and below the recording medium transport path. Along with the ventilation opening, the ventilation path is formed below the photoconductive drum as an image bearing body. The ventilation path promotes convection that is generated by the temperature difference between the temperature within the upper space above the recording medium, subject to a temperature rise due to the fixing section as a heat source, and the temperature within the lower space below the recording medium, subject to relatively less of a temperature rise.

The relatively lower temperature air brought up by convention passes through the ventilation path below the photoconductive drum, passes along the photoconductive drum, the development section, and the cleaning section within the process cartridge while cooling them by contact therewith. This arrangement provides a low-cost and simple cooling capability without using particular dedicated cooling means.

Since the heat sink plate is saucer-like shaped to receive fallen objects through the ventilation path, paper clips and the like are prevented from falling on the circuit board below the heat sink plate. The risk of faults and fire of the electronics is substantially reduced.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and cope of the appended claims. The scope of the following claims is to be accorded the broadest interpretation so as to encompass all modifications and equivalent structures and functions.

What is claimed is:

1. An image forming apparatus, said apparatus comprising:

an apparatus body, including an outer portion having an exhaust opening;

a photoconductive member disposed in said apparatus body;

toner image forming means disposed in said apparatus body for forming a toner image on said photoconductive member;

a recording medium transport path disposed in said apparatus body for allowing to pass therethrough a sheet-like recording medium, to which the toner image formed on said photoconductive member is to be transferred;

transfer means, disposed in said apparatus body along said transport path below said photoconductive member, for transferring the formed toner image to the recording medium;

fixing means disposed in said apparatus body above a plane of said recording medium transport path and having a heater body, for fixing the toner image transferred to the recording medium by said transfer means; and a partitioning member which separates an interior of said apparatus body into a lower space and an upper space, the upper space containing said transfer means, said photoconductive member, said toner image forming means, and said fixing means, said partitioning member having a ventilation opening for permitting air to flow along a ventilation path from the lower space through the upper space near said transfer means and out the exhaust opening, wherein a convective air flow generated when said fixing means is heated rises along said ventilation path and passes near said transfer means and around said photoconductive member and said toner image forming means, arranged above the ventilation opening in said partitioning member, and is exhausted through the exhaust opening in said outer portion of said apparatus body.

2. An apparatus mechanism according to claim 1, wherein a circuit board is arranged below said partitioning member.

3. An apparatus according to claim 2, wherein a heat sink plate of the circuit board is arranged between the ventilation opening formed in said partitioning member and said circuit board.

4. An apparatus according to claim 1, wherein an air flow that has passed through the ventilation opening formed in said partitioning member passes through a space between said photoconductive member and said fixing means, and is then exhausted outside said apparatus body through the exhaust opening in said outer portion of said apparatus body.

5. An apparatus according to claim 1, wherein said photoconductive member and said toner image forming means are supported in an integrally constructed cartridge that is detachably mounted in said apparatus body.

6. An apparatus according to claim 1, wherein the exhaust opening in said outer portion of said apparatus body is constituted by said transport path through which the recording medium advances.

7. An apparatus according to claim 1, wherein the exhaust opening in said outer portion of said apparatus body is constituted by an opening formed as an exhaust passage.

8. An image forming apparatus, comprising:

an image bearing member for bearing a toner image;

a transfer member for transferring the toner image on said image bearing member to a recording material, said transfer member being disposed in contact with said image bearing member;

fixing means for fixing the transferred toner image onto the recording material, said fixing means being provided with a heating member;

a housing having a first space in which said fixing means, said image bearing member and said transfer member are disposed, and a second space disposed below the first space;

a partition member disposed between the first space and the second space;

a first ventilation opening provided in said partition member, said ventilation opening being disposed below said transfer member; and a ventilation path formed by the ventilation opening, said transfer member and said image bearing member.

9. An apparatus according to claim 8, wherein air flows from the second space into the first space through the ventilation opening when a natural convection of air is generated.

10. An apparatus according to claim 9, wherein the natural convection of air is thermal convection of air generated when said heating member of said fixing means is heated.

11. An apparatus according to claim 8, wherein said image bearing member is disposed above said transfer member.

12. An apparatus according to claim 8, wherein said transfer member is a roller.

13. An apparatus according to claim 8, wherein an electrical component is provided in the second space.

14. An apparatus according to claim 8, wherein air flow which passes through the ventilation path is exhausted outwardly from within said apparatus.

15. An apparatus according to claim 8, further comprising a falling preventing member for preventing an object which passes through the ventilation opening from falling into the second space.

16. An apparatus according to claim 8, wherein said partition member comprises a rib-type wall drawn in a vertical direction and the ventilation opening is provided on said rib-type wall.

17. An apparatus according to claim 8, wherein said partition member comprises a rib-type wall disposed between the ventilation opening and said transfer member and drawn in a vertical direction, with said rib-type wall being provided with a second ventilation opening different from the first ventilation opening.

18. An apparatus according to claim 8, further comprising cleaning means for cleaning said image bearing member.

19. An apparatus according to claim 8, wherein said image bearing member is a rotary member.

20. An apparatus according to claim 8, wherein said image bearing member also bears an electrical image.

21. An image forming apparatus, comprising:

an image bearing member for bearing a toner image;

transfer means for transferring the toner image on said image bearing member to a recording material;

fixing means for fixing the transferred toner image onto said recording material, said fixing means being provided with a heating member;

a housing having a first space in which said fixing means, said image bearing member and said transfer means are disposed, and a second space disposed below said first space;

a partition member disposed between the first space and the second space;

a ventilation opening provided in said partition member, the ventilation opening being disposed below said transfer means; and a ventilation path formed by the ventilation opening, said transfer means and said image bearing member, wherein when a natural convection of air is generated, air flows from the second space into the first space through the ventilation opening and then passes through the ventilation path.

22. An apparatus according to claim 21, wherein the natural convection of air is thermal convection of air generated when said heating member of said fixing means is heated.

23. An apparatus according to claim 21, wherein air flow which passes through the ventilation path is exhausted outwardly from within said apparatus.

* * * * *

UNITED STATES PATENT AND TRADEMARK OFFICE

CERTIFICATE OF CORRECTION

PATENT NO. : 6,021,290
DATED : February 1, 2000
INVENTOR(S) : Tatsuo Hamada, et al.

It is certified that error appears in the above-identified patent and that said Letters Patent is hereby corrected as shown below:

Column 6,
Line 38, "cope" should read -- scope --.

Column 7,
Line 18, "mechanism" should be deleted.
Line 58, "said" should read -- said first --.
Line 60, "the" should read -- said first --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*